US006252487B1

(12) United States Patent
Wolf et al.

(10) Patent No.: US 6,252,487 B1
(45) Date of Patent: Jun. 26, 2001

(54) PLANAR MAGNETIC COMPONENT WITH TRANSVERSE WINDING PATTERN

(75) Inventors: Ronald M. Wolf, Katonah; Jose Azevedo, Mahopac, both of NY (US)

(73) Assignee: Philips Electronics North America Corporation, New York, NY (US)

( * ) Notice: Subject to any disclaimer, the term of this patent is extended or adjusted under 35 U.S.C. 154(b) by 0 days.

(21) Appl. No.: 08/963,938

(22) Filed: Nov. 4, 1997

(51) Int. Cl.[7] ..... H01F 27/02; H01F 17/04
(52) U.S. Cl. ..... 336/221; 336/206; 336/83
(58) Field of Search ..... 336/206, 221, 336/83, 213

(56) References Cited

U.S. PATENT DOCUMENTS

| | | | | |
|---|---|---|---|---|
| 2,064,771 | * | 12/1936 | Vogt | 336/221 |
| 3,210,705 | | 10/1965 | Lockie . | |
| 3,223,923 | * | 12/1965 | Howell | 336/221 |
| 3,609,613 | | 9/1971 | Horn et al. | 336/83 |
| 3,662,461 | * | 5/1972 | Lake et al. | 336/336 |
| 4,021,764 | * | 5/1977 | Winn | 336/84 |
| 4,135,173 | * | 1/1979 | Philp | 336/220 |
| 4,400,226 | * | 8/1983 | Horrigan | 156/56 |
| 4,507,640 | * | 3/1985 | Rich, III et al. | 336/223 |
| 4,516,104 | * | 5/1985 | McDermott | 336/206 |
| 4,583,068 | * | 4/1986 | Dickens et al. | 336/83 |
| 4,630,013 | * | 12/1986 | Takada | 334/12 |
| 4,675,638 | * | 6/1987 | Szabo | 336/83 |
| 5,296,830 | | 3/1994 | Tamada et al. | 336/192 |
| 5,710,745 | * | 1/1998 | Getreuer | 336/83 |
| 5,726,615 | * | 3/1998 | Bloom | 336/83 |
| 5,767,760 | * | 6/1998 | Mollie et al. | 336/205 |

FOREIGN PATENT DOCUMENTS

| | | | | |
|---|---|---|---|---|
| 24 09 881 | * | 9/1975 | (EP) | 336/83 |
| 572857 | * | 7/1975 | (SU) | 336/213 |

* cited by examiner

*Primary Examiner*—Michael L. Gellner
*Assistant Examiner*—Anh Mai
(74) *Attorney, Agent, or Firm*—F. Bruce Faller

(57) ABSTRACT

A high-leakage planar magnetic component such as an inductor, having a winding structure in which flat winding turns are oriented transverse to the plane of the winding structure, exhibits significantly lower winding losses than components having a stacked arrangement of flat winding turns parallel to the plane of the winding structure. A dense winding structure having such a transverse orientation can readily be made by forming a flat conductor into a coil using conventional wire winding techniques.

11 Claims, 7 Drawing Sheets

PLANAR MAGNETIC COMPONENT WITH TRANSVERSE WINDING PATTERN

BACKGROUND OF THE INVENTION

This invention relates to planar magnetic components, and more particularly relates to such components which include a core and a planar winding structure, such as planar inductors and transformers.

Planar magnetic components, particularly those characterized by relatively high leakage flux, such as inductors and some transformers designed to have built-in inductance, are useful in power electronics applications in which space is limited, for example, electronic lamp ballasts and switched-mode power supplies.

Conventional planar magnetic components have winding structures which consist of a stack of layers each containing part of the total winding structure, insulating layers usually consisting of a flexible, non-conducting, low permittivity, high temperature resistant polymer to prevent electrical contact between the turns in adjacent layers, and a contacting structure that permits electrical contact between turns in adjacent layers where needed. The winding structures are usually made by etching or stamping or sometimes by folding. Contacts are usually made by soldering or via plating.

An improved planar magnetic component with planar winding structure which is compact, in which the winding layers are readily interconnected, and which can be readily connected to external circuitry, is described and claimed in co-pending U.S. patent application Ser. No. 08/874,171 (Attorney docket number PHA 23,256) filed Jun. 13, 1997, and assigned to the present assignee. The density of the planar winding structure results in a relatively low thermal resistance, compensating somewhat for the lower surface area available for heat transfer.

Winding losses occur in all such magnetic components. In general, winding losses are due to the interaction of the winding current with a local magnetic field, due largely to leakage flux from the windings and to stray fields near the gaps in the core. The leakage flux, defined as the magnetic flux not present in either the core or the gaps, is relatively high in inductors as well as in some transformers, which are designed to have built-in inductance, such as those sometimes used in switched mode power supplies and lamp ballasts.

In such high-leakage flux applications, there is a need to reduce the winding losses, while at the same time preserving or even enhancing the advantages of the known planar magnetic components.

OBJECTS AND SUMMARY OF THE INVENTION

Accordingly, it is an object of the invention to provide a high-leakage-flux planar magnetic component with reduced winding losses in the winding structure.

It is another object of the invention to provide such a magnetic component which is compact.

It is another object of the invention to provide such a magnetic component in which the winding layers are readily interconnected.

It is another object of the invention to provide such a planar magnetic component which can be readily connected to external circuitry.

In accordance with the invention, a high-leakage-flux magnetic component, comprising a core and a planar winding structure, is characterized in that the winding structure comprises inner and outer planar windings oriented substantially transverse to the plane of winding structure, the inner winding being wholly inside and concentric to the outer winding.

As used herein, the term "winding window" is meant to refer to the opening in the core which accommodates the winding structure, as seen in a cross section of the core taken transverse to the plane of the winding structure.

In such a winding structure in which the core has one or more gaps which are generally coplanar with the plane of the winding, for example, the core is divided into core components having facing planar surfaces separated from one another, the plane of the winding turns substantially coincides with the path of the leakage flux across the winding window. Eddy current losses are thereby minimized, resulting in considerably lower winding losses.

Moreover, with such a transverse orientation of the windings, it is possible to form the winding structure by winding a flat conductor into a coil, enabling a very compact structure having a high density and mechanical rigidity.

Such a structure has several advantages over the stacked structures of the prior art. For example, the high density of such a structure enables a high fill factor of the conductor, which also contributes to lower winding losses. The high density also reduces the thermal resistivity of the winding. In addition, such structures can be pinned or soldered directly to a circuit board, thereby reducing the thermal resistivity between the structure and the board.

In addition, such a structure may be fabricated using conventional wire winding techniques, with no interconnections between layers being required. With such advantages, even smaller core sizes are possible.

Accordingly, a preferred embodiment of the invention comprises such a planar magnetic component in which the winding structure comprises such a wound flat conductor.

In accordance with another embodiment of the invention, the thickness of the conductive turns of the winding is no more than three times, and preferably no more than two times, the current skin depth at the operating frequency of the device. For copper, the skin depth at room temperature (in cm) is given by $$\Delta = 6.57\sqrt{1/f}$$

where f is the operating frequency in Hz. Typical operating frequencies of 50 kHz, 250 kHz and 1 MHZ correspond to skin depths of about 0.29 mm, 0.13 mm and 0.065 mm, respectively.

DESCRIPTION OF THE PREFERRED EMBODIMENTS

Figure 1:
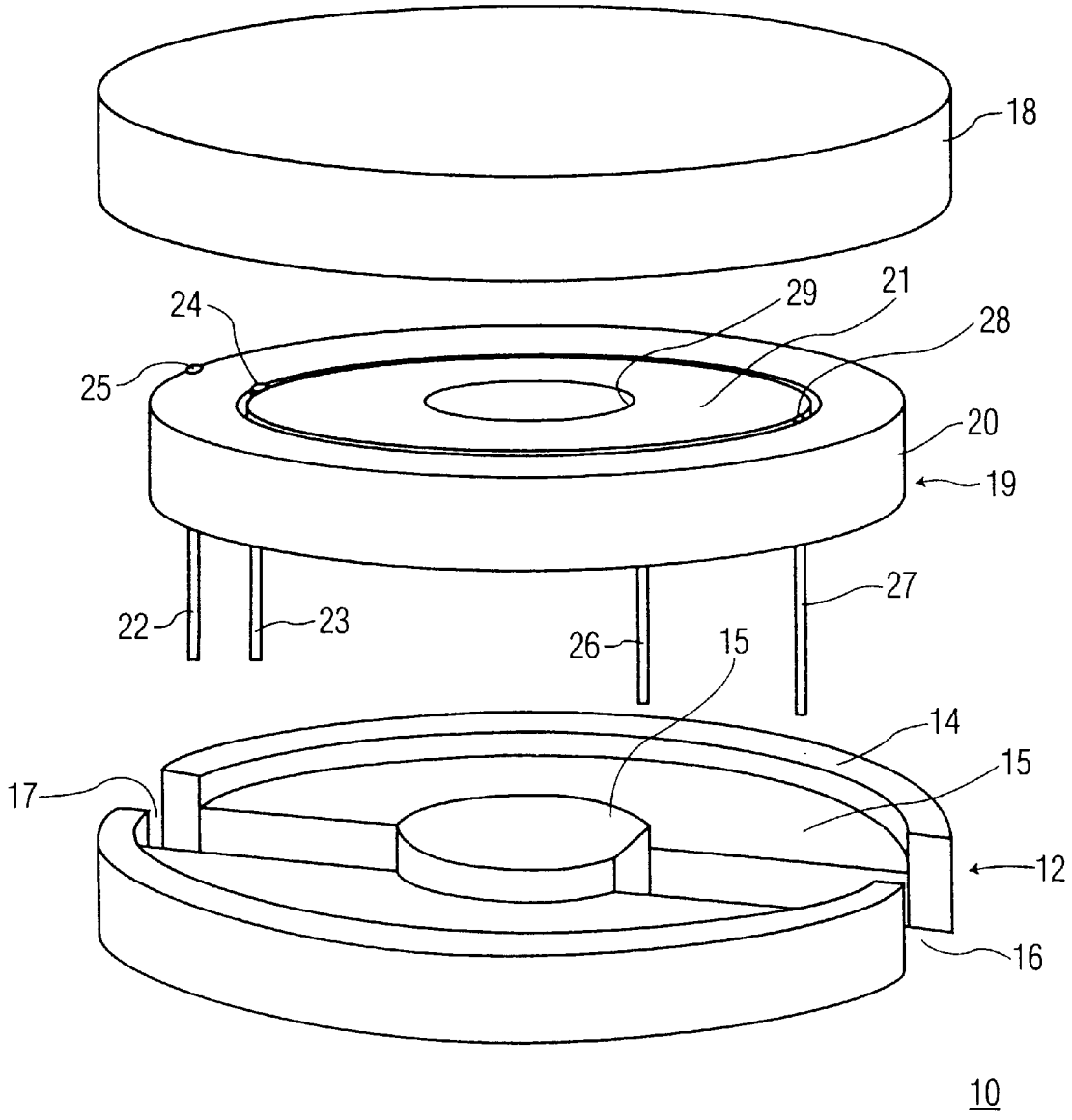
FIG. 1 is a perspective view of one embodiment of a planar magnetic component of the invention, including a lower core portion, a winding structure, and an upper core portion.

The invention will now be further elucidated by a detailed description of certain preferred embodiments of the invention, in conjunction with the drawings, in which the same reference numerals are used to indicate similar features or elements in different figures.

Referring now to FIG. 1, there is illustrated one embodiment of a low profile component 10 of the invention, including a lower core section 12 of a composite ferrite core, an upper core section 18, and a winding structure 19, all being in the general shape of planar cylindrical sections. Lower core section 12 has a planar base portion 13, an outer upstanding rim 14 and a central mesa 15, both located on the upper surface of the base portion 13, which together define an annular depression for receiving the winding structure 19. Slots 16 and 17 in the base portion 13 accommodate the passage of leads from the winding structure.

Winding structure 19 has an outer winding 20 and a concentric inner winding 21, each winding consisting of a coil of a flat electrically conductive material, typically copper, on a polyimide backing layer. Since the layers of conductor and backing 19 are co-extensive, i.e., the conductor is not patterned, the windings can be tightly coiled into a planar body having few voids. The density and rigidity of the body can be further enhanced by coating it with a potting compound, such as liquid epoxy.

The winding may be conveniently provided by starting with a sheet of commercially available metal/insulating polymer foil, such as copper/kapton, consisting of a 1 mil thick polymide sheet supporting a copper foil, approximately 4 to 5 mils thick. If the desired thickness of copper is not readily available, additional copper may be deposited, for example, by electroplating, to build up the layer to the desired thickness. The compactness and rigidity of the final structure enables such thicknesses, which in turn enables formation of conductive tracks having a sufficient cross section to carry the current needed for high power applications.

As an alternative to a composite foil, separate metal and polymer or other insulating layers may be wound together.

Figure 6:
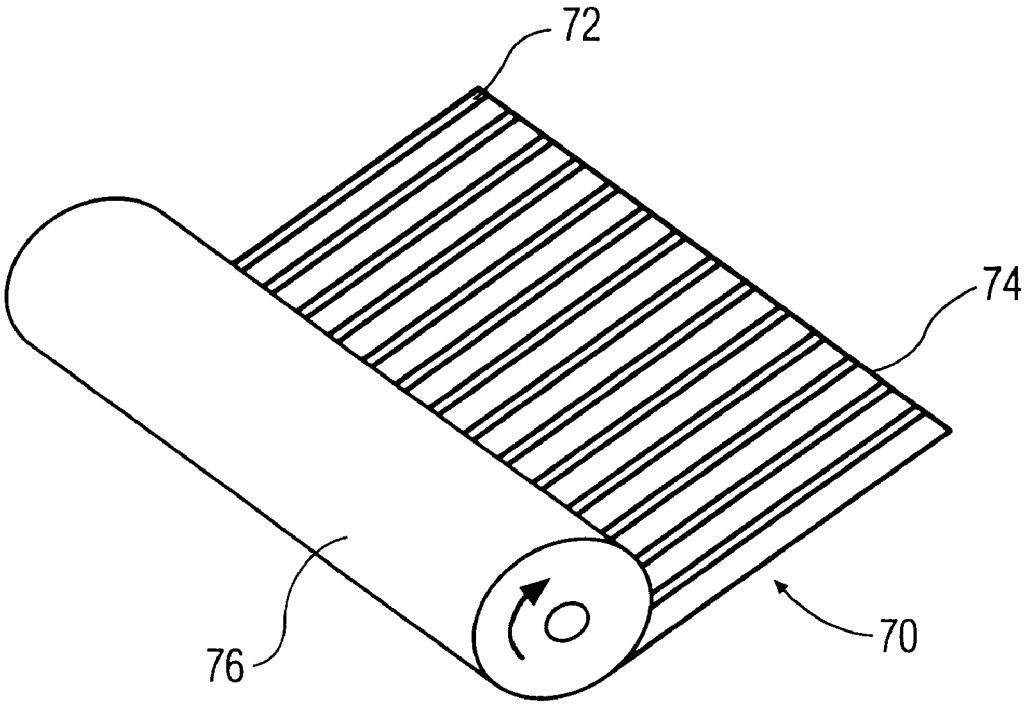
FIG. 6 is a schematic illustration of a possible method of forming the winding structures of the invention.

In a mass production environment, it may prove convenient to form the winding structures by slicing them from a roll formed by winding foil sheets around a holder or mandrel. Contacting structures can be inserted into the roll at appropriate locations during the rolling process. In subsequent steps, the slices are treated to prevent the exposed sides of the metal layer from contacting the core, either by covering them with a non-conducting layer, or by etching them back and filling the resultant spaces between the polymer foil with a non-conducting material. Alternatively, where a composite foil sheet 70 is used, the conductive layer can be provided as spaced parallel conductor tracks 74, one for each winding structure, so that upon slicing each winding structure from the roll 76 midway between the tracks 74 (see FIG. 6), the edges of the tracks are already recessed from the edges of the polymer foil, and no further steps are needed to insulate these edges from the core.

Returning to the winding structure 19 shown in FIG. 1, the inner winding 21 was formed by winding a flat conductor on a cylindrical mandrel to form a central aperture in the winding structure of sufficient diameter to accommodate the central mesa 15 of the lower core portion.

Leads 22 and 23, electrically connected to outer winding 20 at points 24 and 25, and leads 26 and 27, electrically connected to inner winding 21 at points 28 and 29, pass through the slots 16 and 17 in the lower core (base)portion 13. After assembly, the upper core portion 18, which as upper and lower planar surfaces, rests on and is bonded to the rim 14 and mesa 15 of the lower core portion.

Any spaces between the core and the winding body can be filled with a dielectric potting compound, such as epoxy, which fixes the spaces, preventing creep and insuring against electrical discharges between the coil and the core.

To demonstrate the influence of winding turn orientation on winding losses, finite element modeling was used to calculate the winding losses for simple planar inductor structures as a function of the orientation of the winding turns with respect to the horizontal plane of the core, which normally corresponds to the longest dimension of the core. The core is composed of lower, middle and upper core portions 30, 32 and 34, respectively, which are separated from one another by air gaps 36 through 39, all having the same width "g". The winding conductor is copper.

Figure 2A:
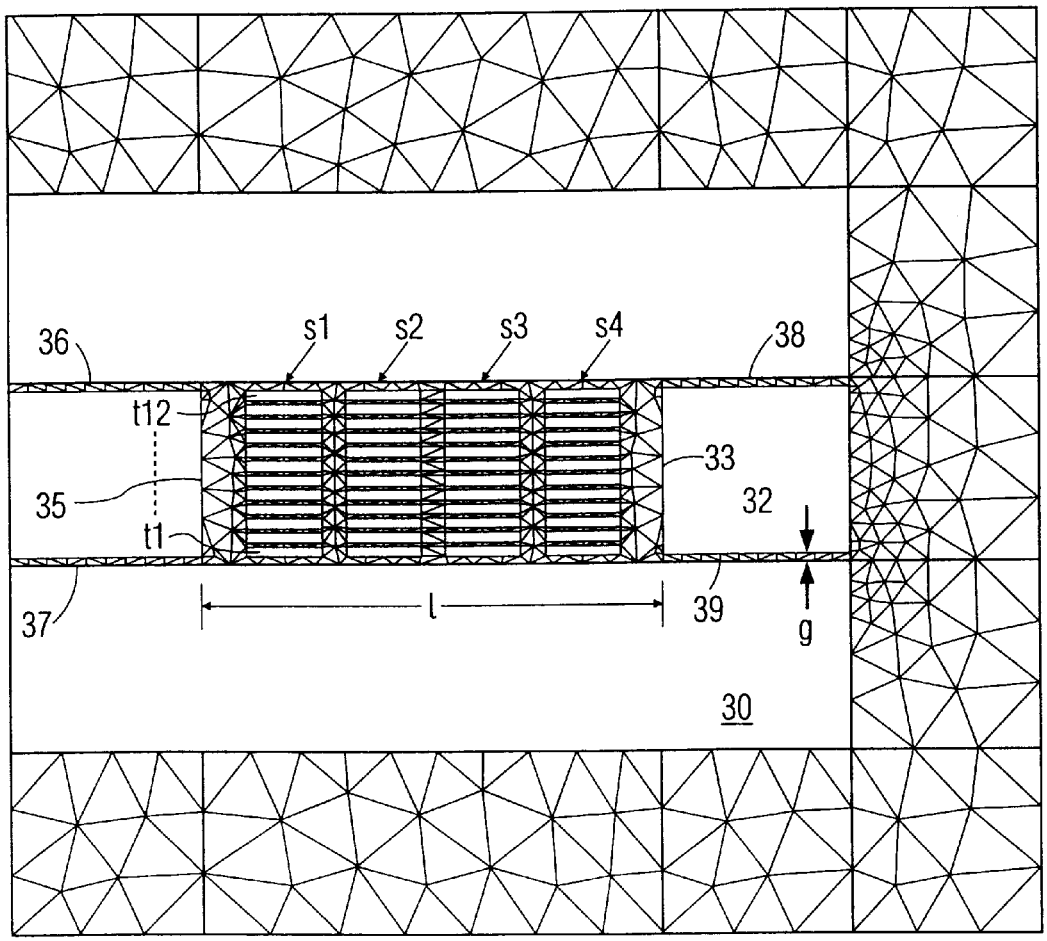
FIG. 2a (PRIOR ART)
FIG. 2*a* is a schematic illustration of a core and winding arrangement of the prior art, in which the plane of the winding turns is oriented parallel to the plane of the winding structure.
Figure 2B:
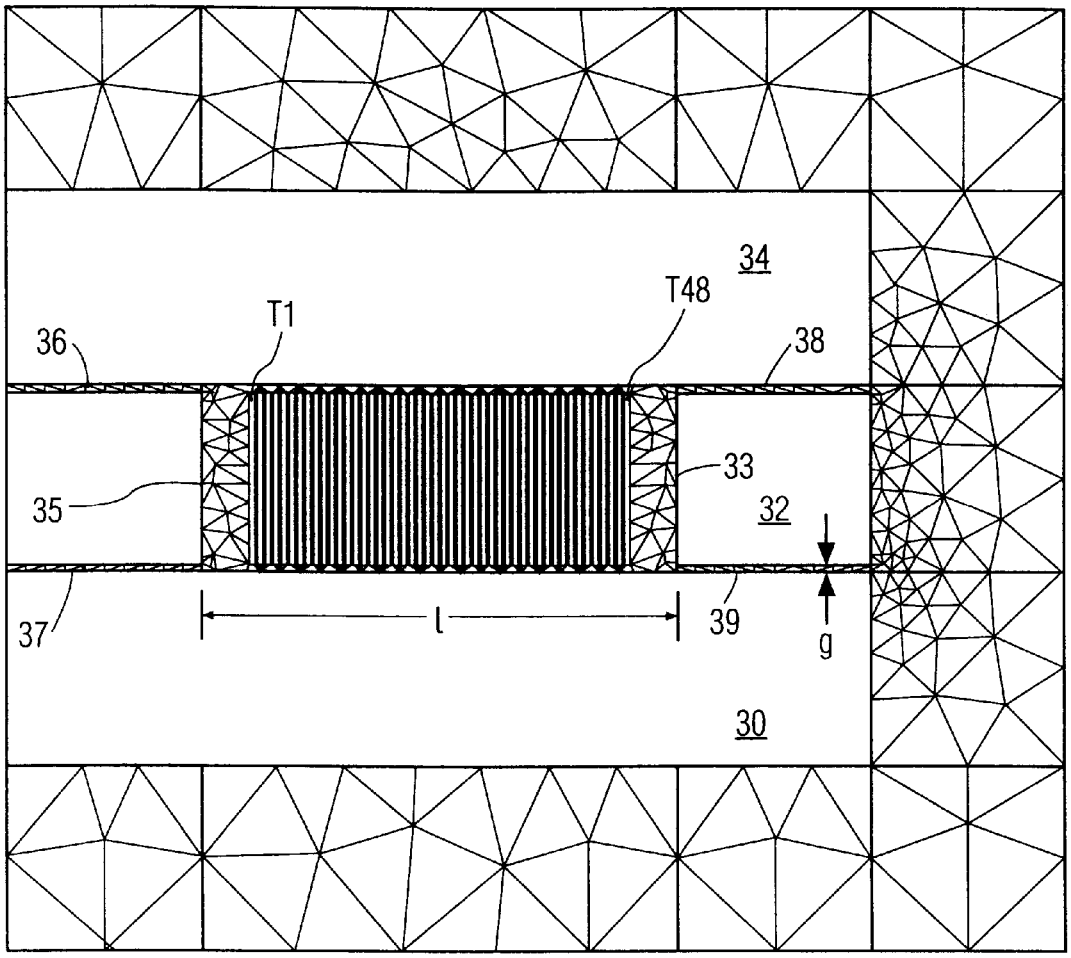
FIG. 2*b* is a schematic illustration of a core and winding arrangement of the invention, in which the plane of the winding turns is oriented transverse to the plane of the winding structure.

The two cases are shown schematically in FIGS. 2*a* and 2*b*, both cases having a winding set containing forty eight turns. The turns in the middle core portion 32 of the prior art (FIG. 2*a*) are each horizontally oriented, i.e., parallel to the plane of the winding structure and to the longest dimension "1" of the winding window, defined by the interior sides 33 and 35 of the middle core portion 32. The turns are divided into four stacks s1 through s4, of twelve turns t1 through t12.

The middle core 32 in accordance with the invention (FIG. 2*b*), has 48 turns T1 through T48 of a conductive ribbon oriented vertically, i.e., perpendicular to the plane of the winding structure and to the longest dimension "1" of the winding window. However, the total cross-section of copper, the total excitation current and the inductance is the same in both cases.

Figure 3:
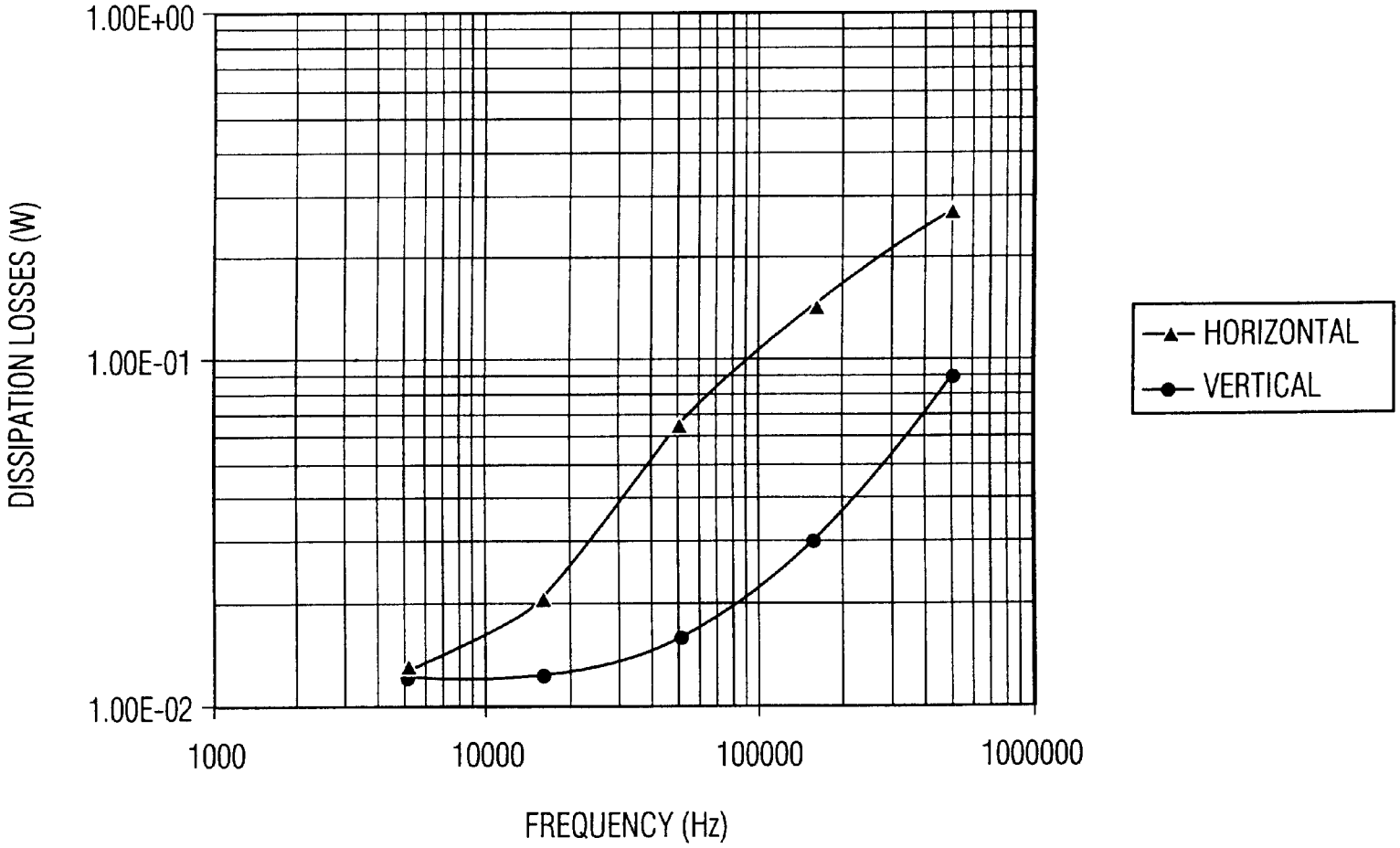
FIG. 3 is a graphical illustration of dissipation losses in Watts vs. operating frequency in Hz of magnetic components having the core and winding arrangements of FIGS. 2*a* and 2*b;*

FIG. 3 shows the dissipation losses in Watts (calculated at the center of the winding structure) plotted vs. operating frequency (Hz) for the two cases described. As can be seen, from around 5000 Hz operating frequency, the dissipation losses for the two cases begin to diverge, with the losses for the vertical winding structure (FIG. 2*b*) lower than for the horizontal structure (FIG. 2*a*). The difference reaches a maximum in the region from about 50,000 Hz, at which AC losses begin to become significant for these types of high-leakage devices, to about 100,000 Hz, above which the curves begin to converge slightly, although the difference in losses remains significant. At about 50,000 Hz, the dissipation losses for the "vertical" case are lower by almost a factor of three. At higher frequencies, the difference in losses between the two cases is even larger.

Figure 4:
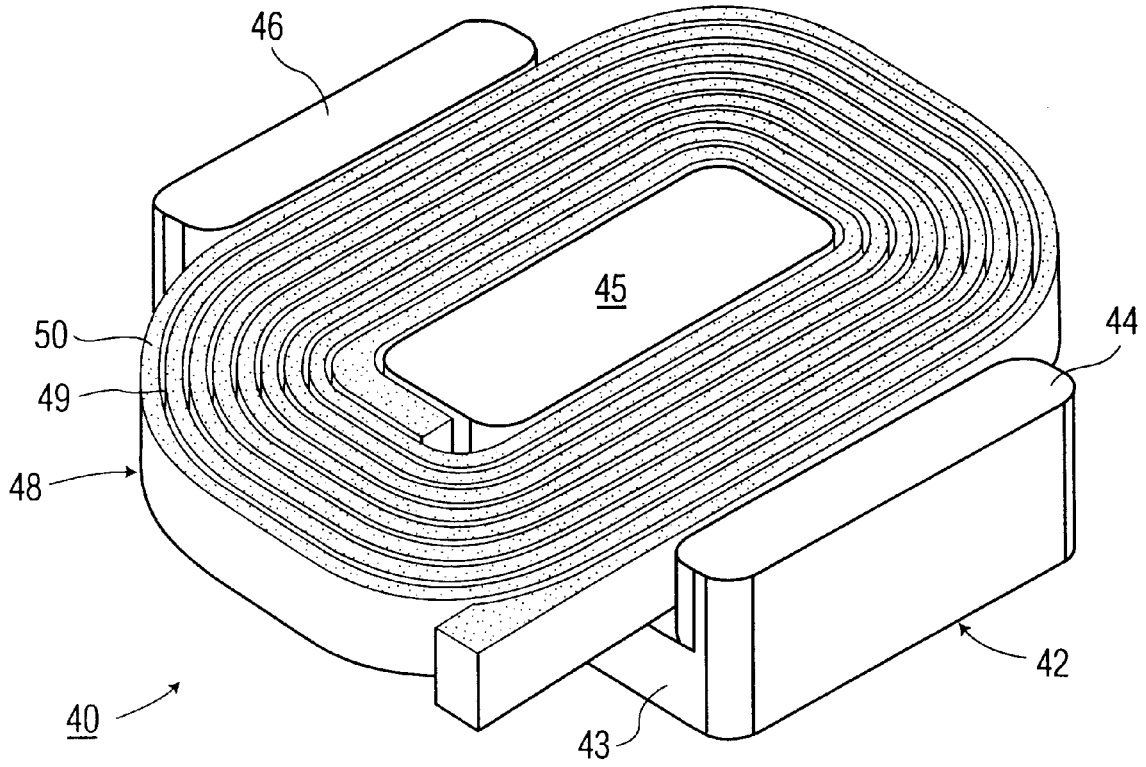
FIG. 4 is a perspective view of a portion of another embodiment of a planar magnetic component of the invention, in which an oval-shaped winding of a flat conductor is positioned in the lower "E" portion of a magnetic core.

Referring now to FIG. 4, there is illustrated a portion of another embodiment of a low profile inductor component 40 of the invention, including the lower "E" core 42 of a composite ferrite core, so named for the E-shape resulting from the upstanding portions 44, 45 and 46 on the base portion 43. A top "I" core, not shown, having a planar configuration, is bonded to the top of the E core in the completed assembly.

Arranged in the spaces between the upstanding portions 44, 45 and 46 of the core is an oval-shaped winding body 48, consisting of a coiled winding made of a ribbon of flat electrically conductive material 49, typically copper, on a polyimide substrate 50.

Figure 5A:
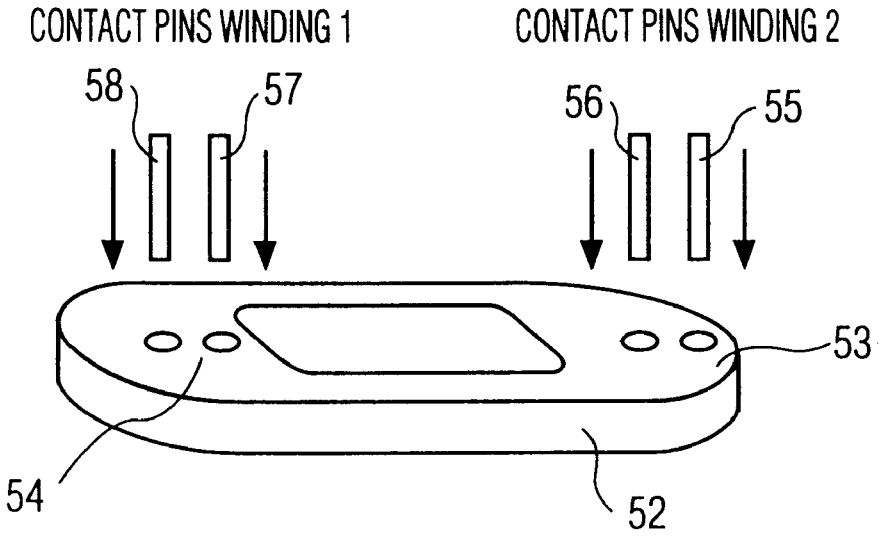
FIGS. 5*a* and 5*b* are perspective illustrations of two different ways of making external connections to the FIG. 4 embodiment of the winding structure of the invention.
Figure 5B:
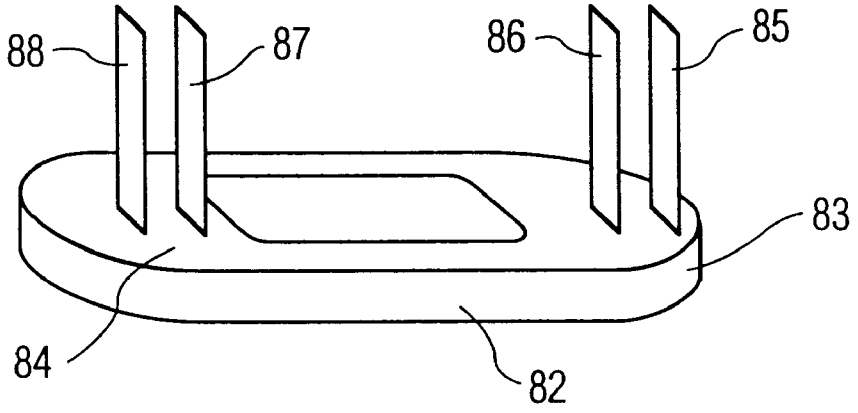

An additional advantage of the winding structure of the invention is that external connections are readily achievable. FIGS. 5*a* and 5*b* show two possible ways in which such connections may be accomplished for the structure of FIG. 4. In FIG. 5*a*, tubular contacts (e.g., hollow wires) 55 through 58 are employed for each of a pair of windings 53, 54 in a single winding structure 52. Such a structure can be fabricated, for example, by the rolling technique described above, wherein a break in the conductive layer defines the end of the first winding and the beginning of the second winding. Hollow wires are inserted into the structure at the desired locations during the rolling process. Subsequent slicing of the roll to obtain individual winding structures exposes the hollow wires, to which solder or pin connections can be made.

FIG. 5*b* shows an alternate way to provide external connections, i.e., to the termini 85 through 88 of the flat conductors which have been fed out of the windings 83 and 84 of the structure 82 by means of a right-angle fold out of the winding plane.

The planar magnetic components of the invention described above allow the core and/or the winding structure to contact a printed circuit board along its lower surfaces. The large contact area between the component and the board promotes the conduction of heat from the component to the board.

The invention has been necessarily described in terms of a limited number of embodiments and variations. Other embodiments and variations of embodiments will become apparent to those skilled in the art, and are intended to be encompassed within the scope of the appended claims.

What is claimed is:

1. A transformer comprising a core having therein a winding window, said core having a central section and a concentric rim defining a longest dimension of said winding window between said rim and said central section, and a planar winding structure accommodated in said winding window, said winding structure comprising an inner winding and an outer winding, said inner winding being situated around said central section, wholly inside and concentric to said outer winding, each winding comprising a coil of flat electrically conductive material which is oriented transversely to the longest dimension of the winding window.

2. A transformer as in claim 1 further comprising an insulative backing on the conductive material of each winding.

3. A transformer as in claim 1 wherein said winding structure has a circular profile.

4. A transformer as in claim 1 wherein said winding structure has an oval profile.

5. A transformer as in claim 1 wherein said core comprises a lower core section and an upper core section, said winding structure being sandwiched between said core sections.

6. A transformer as in claim 5 wherein the entire winding is covered by said upper and lower core sections.

7. A transformer as in claim 1 wherein each of said windings has a pair of terminals extending at a right angle to the plane of the winding.

8. A transformer as in claim 7 wherein each terminal is formed by folding said flat conductor so that it extends transversely to the plane of said winding structure.

9. A transformer as in claim 7 wherein each terminal comprises a tubular contact inserted in the winding structure, and a pin inserted in the tubular contact.

10. A transformer as in claim 7 wherein each pair of terminals is aligned along a radius of the respective winding.

11. A transformer as in claim 10 further comprising a core section received against said winding structure, said core section having slot means for receiving said terminals therethrough.

* * * * *